United States Patent [19]

Metzger

[11] 4,352,727

[45] * Oct. 5, 1982

[54] ROTOGRAVURE CYLINDER PLATING AND DE-PLATING APPARATUS

[75] Inventor: Hubert Metzger, Milwaukee, Wis.

[73] Assignee: Printing Machinery & Electronics Corporation, Inc., Milwaukee, Wis.

[ * ] Notice: The portion of the term of this patent subsequent to Oct. 5, 1999, has been disclaimed.

[21] Appl. No.: 255,281

[22] Filed: Apr. 17, 1981

Related U.S. Application Data

[63] Continuation-in-part of Ser. No. 211,562, Dec. 1, 1980.

[51] Int. Cl.[3] ..... C25D 17/00; C25D 17/12

[52] U.S. Cl. ..... 204/212; 204/25; 204/272; 204/285

[58] Field of Search ..... 204/212, 285, 25, 272, 204/275

[56] References Cited

U.S. PATENT DOCUMENTS

| | | | |
|---|---|---|---|
| 1,381,882 | 6/1921 | Merritt | 204/212 |
| 1,792,998 | 2/1931 | Melish | 204/285 |

FOREIGN PATENT DOCUMENTS

| | | | |
|---|---|---|---|
| 2449735 | 4/1976 | Fed. Rep. of Germany | 204/212 |
| 715436 | 9/1954 | United Kingdom | 204/285 |
| 442236 | 9/1974 | U.S.S.R. | 204/13 |

*Primary Examiner*—T. M. Tufariello

*Attorney, Agent, or Firm*—Littlepage & Webner

[57] ABSTRACT

Polypropylene plastic baskets for phosphorized or non-phosphorized copper anode nuggets are suspended, one on each side of a cylinder to be plated, in a bath of plating electrolyte. The tops of the baskets are disposed beneath the surface of the plating solution, the upper portion of the cylinder is above the surface of the electrolyte, lead anode conductor strips extend downwardly along the insides of the rear walls of the baskets, and the front walls of the baskets are perforated.

When the cylinder is printed out, it is returned to the plating apparatus and reversably plated so as to return the copper to the nuggets. In order to prevent the copper from building up through the perforations in the inner walls of the baskets, a porous plastic sheet is disposed over the inner surface of the inner walls of the baskets.

6 Claims, 2 Drawing Figures

ROTOGRAVURE CYLINDER PLATING AND DE-PLATING APPARATUS

RELATED APPLICATION

Figure 1:
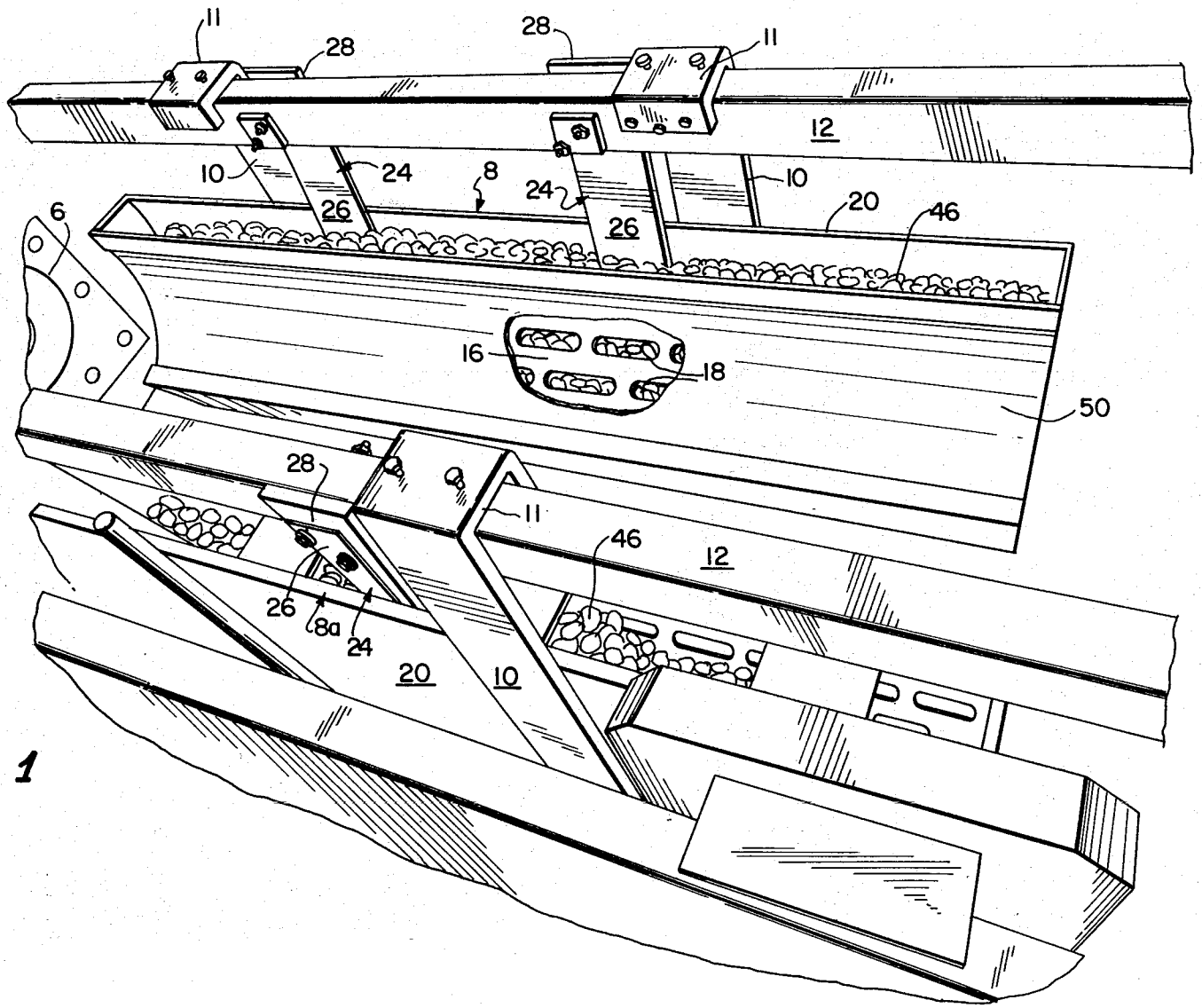

U.S. application; Metzger, Ser. No. 06/211,562 ROTOGRAVURE CYLINDER PLATING APPARATUS file Dec. 1, 1980, of which this is a continuation-in-part.

FIELD OF THE INVENTION

Chemistry, electrical and wave energy, processes and products, coating, cylinders, rolls or hollow articles.

OBJECTS

In electroplating rotogravure cylinders, it is customary to rotate the cylinder, as a cathode, in a bath of electrolyte in which copper nuggets are supported in curved baskets disposed one on each side of the cylinder. Heretofore, the anode baskets typically were of titanium, which greatly limited the current-carrying capacity, and at spot contacts the titanium burned out. The object of this invention is to provide concavo-convex baskets for the copper nuggets which are made of plastic, i.e., polypropylene, supported by non-current-carrying, protectively-coated hangers in the electrolyte bath. The concave or front walls of the baskets which face the cylinder are perforate, and curved lead anodes extend downwardly along the inner sides of the rear walls of the baskets and contact the copper nuggets. The copper nuggets, since they surround three sides of the lead anodes and are disposed between the lead anodes and the cylinder thus protect the lead anodes against wear-out; and the baskets, being of nonconductive plastic material, are not subject to burn out at "hot spots."

A further object is to provide a cylinder-plating apparatus of the type described, in which the top of the rotating cylinder to be plated is disposed above the surface of the electrolyte so that a washing action occurs as the surface of the cylinder sweeps across the surface of the electrolyte; in which the tops of the baskets are disposed below the surface of the electrolyte so as to ensure free circulation of constantly-refreshed electrolyte; and in which the electrolyte is injected via a manifold into the bath at a location along the bottom of one basket which is less than 180° from the top of the cylinder, as measured in the direction of the cylinder rotation, the injection being in the direction of cylinder rotation. By this means, the electrolyte is entrained and carried along with the cylinder between the cylinder and the basket thence against the top of the cylinder and over the baskets.

The foregoing objects are those of the invention disclosed in my co-pending application, (supra). This invention relates to the following additional feature:

Heretofore, after the plated cylinder had been engraved and then printed out the cylinder, with a "Ballard" shell on it, was moved to the plating department for stripping. However, instead of using a Ballard shell, some concerns simply use base copper on the cylinder; and when such a cylinder has been printed out, it is returned to the plating bath and reversably plated so as to return the engraved copper surface back to the copper nuggets in the baskets. The cylinder is made positive, the anode minus, and deplating ensues for any length of time needed.

While the foregoing innovation was effective for removing the engraved surface copper from the cylinder, copper would build up in the perforations through the inner walls of the nugget-containing baskets and form "trees," i.e., rough copper growths so extensive as to extend into the space between the inner walls of the baskets, even to the cylinder itself, thereby damaging the cylinder when it was rotated. The object of this invention is to prevent the formation of these "trees" when the cylinder is deplated. To achieve this end, a porous plastic sheet is disposed over the inner surface of the inner walls of the baskets. This has been found to completely eliminate the "tree" problem.

Figure 2:
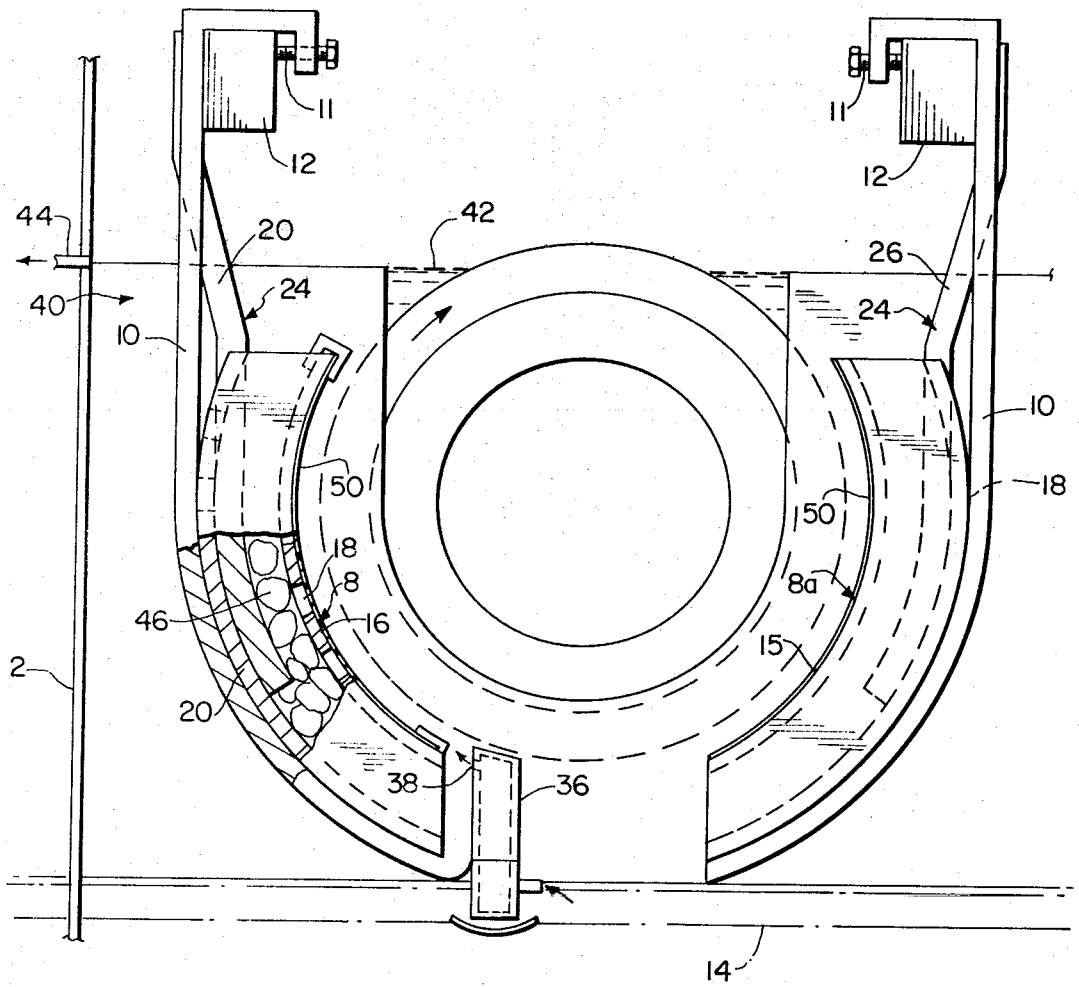

These and other objects will be apparent from the following specifications and drawings, in which FIG. 1 is a fragmentary perspective view of the baskets, with the cylinder removed;

FIG. 2 is an end elevation, partly broken away showing the baskets and their mountings;

Referring now to the drawings in which like reference numerals denote similar elements, the plating apparatus includes a tank having an end wall 2. A cylinder 4 to be plated is rotatably supported at its ends by bearings 6, in which it is rotatably driven by a suitable power device, not shown. Since the tank and cylinder mounting and drive are conventional, they are not detailed. On each side of the cylinder are disposed concavo-convex baskets 8 and 8*a* of polypropylene whose concave walls are disposed towards the cylinder. The baskets are suspended by hanger bars 10 attached as at 11 to current-carrying rails 12. The ends of the rails are conventionally supported by the tank ends. The inner walls 16 of the baskets have perforations 18 and the outer sides 20 of the baskets are blind, except for two rows of holes near their tops which permit plating solution to flow through. Suspended within the baskets and against the inner sides of outer walls are lead anodes 24 which consist of curved flat strips 26 attached as at 28 to the anode rail. The upper portions of the lead anode strips 26 are coated to protect them from the electrolyte and the lower portions are bare and in intimate contact with the copper nuggets 34. Mounted along the lower inner wall of basket 8 is a manifold 36, which is less than 180° away from the top of the cylinder and which is provided with jet outlets 38 which inject electrolyte 40 between the basket and cylinder and in the direction of basket rotation. Electrolyte 40 consisting of 220–250 g/liter copper sulphate and 60 g/liter sulfuric acid fills the tank to a level 42. High phosphor copper mini-nuggets 46, preferably 0.04 to 0.06 percent phosphor, are used. Plastic shield plates 48 are used when cylinders of shorter length are plated so as to prevent over-plating at the cylinder ends.

In operation, the packing of the copper nuggets around the lead anode strips and between the lead anode strips and the cylinder being plated protects the lead anode strips against wear-out. To ensure complete and constant exchange of the electrolyte, the tops of the baskets must always be below the top of the cylinder: otherwise the baskets dam up the electrolyte and cause it to stagnate between the baskets and the cylinder and to over-heat. The top of the cylinder should be above the level of the electrolyte so as to produce a washing action as the surface of the cylinder leaves and enters the electrolyte. Without these precautions the cylinder plating is rough.

The invention described in the foregoing specifications is that of my co-pending application (supra), and it has proved to be highly successful insofar as concerns plating copper from the cylinder onto nuggets. However, when the cylinder was de-plated, copper "trees" formed in the perforations through the inner walls of the plastic baskets. To prevent this, a sheet 50 of porous plastic is secured over the entire length and width of the inner sides of the inner basket walls 16, and in order to cause the de-plated copper to plate onto as much surface as possible of the copper nuggets, the front walls of the baskets are perforated with large elongate holes.

A suitable porous plastic for this purpose is VYON, of a thickness of from 1/32" to 3/16", a material manufactured by Porvair, Ltd. of Norfolk, England. This material has a particle retention in the range of 25 microns and larger. It has the typical excellent chemical resistance of high density polyethylene and is tough, flexible and resilient so as to conform closely against the inner walls of the baskets.

For plating on the cylinder, the rails 12 are connected to the anode side of a plating current power supply and the cylinder 4 is conventionally connected to the other, cathode side of the power supply. For de-plating, the connections are reversed.

I claim:

1. Apparatus for electrolytic plating and deplating of rotogravure cylinders, comprising a tank adapted to contain a plating solution and including means for supporting therein a cylinder for rotation about a horizontal axis in one direction, baskets disposed in said tank, one on each side of the cylinder, with concavo-convex arcuate inner perforate walls closely spaced from the cylinder and outer concavo-convex arcuate walls concentric with and spaced from the inner walls in the direction away from the cylinder, said baskets being of non-conductive material, elongate metallic current-conductor strips, having upper protectively coated portions disposed above the baskets, and lower bare portions extending downwardly along inner sides of the outer basket walls, said lower portions being arcuate and concentric with the cylinder, means for connecting a source of current to the upper portions of the conductor strips and to the cylinder, nuggets of metal packed in said baskets between the lower portions of said conductor strips and the front walls of the baskets, said baskets having tops disposed below the top of the cylinder, and supply and return means for maintaining plating solution in the tank with the level thereof below the top of the cylinder and above the tops of the baskets, and a sheet of porous plastic material covering the concave sides of the inner-perforate walls of the baskets and disposed between said inner sides of the baskets and the cylinder for preventing build-up of metal through the perforations of the inner basket walls when the cylinder is deplated.

2. Apparatus as claimed in claim 1, the supply means for the plating solution including a manifold disposed along a lower portion of the inner wall of one of the baskets and having jet outlets for injecting plating solution between said porous plastic sheets and said cylinder.

3. Apparatus as claimed in claim 2, wherein the jet outlets are so directed as to inject the plating solution between the porous plastic material sheet and cylinder and in the direction of cylinder rotation.

4. A basket assembly for electroplating and de-plating cylinders, comprising;

a basket adapted to be packed with nuggets of metal and being of non-conductive material and comprised of spaced concavo-convex front and rear walls, the front wall being perforate, said basket being adapted to be suspended in a plating solution with the concave side of the front wall disposed towards the cylinder to be plated, a plurality of elongate current-conductor bars having upper protectively coated portions extending upwardly from said basket and lower bare portions extending downwardly in said basket along the inner side of the rear wall thereof and being spaced from the inner side of the front wall thereof, means for connecting the upper portions of said conductor bars and the cylinder to opposite sides of an electrical current supply circuit, said basket walls and the lower base portions of said bars being curved along arcs of concentric circles, and a sheet of porous plastic material disposed against and covering the concave side of the front wall of the basket assembly, said porous plastic being of high density polyethylene having a particle retention of about 25 microns and larger.

5. A basket assembly as claimed in claim 4, said bars being substantially flat and the lower portions thereof being curved in complement to the concave side of the basket rear wall and with flat sides of the bars engaging against said concave side of said rear basket wall.

6. Apparatus for electrolytic plating and de-plating of rotogravure cylinders, comprising a tank adapted to contain a plating solution and including means for supporting therein a cylinder for rotation about a horizontal axis in one direction, baskets disposed in said tank, one on each side of the cylinder, with inner concavo-convex arcuate perforate walls closely spaced from and concentric with the cylinder and outer walls spaced from the inner walls in the direction away from the cylinder, said baskets being of non-conducting plastic material, elongate metallic current conductor strips having upper protectively coated portions disposed above the baskets, and lower bare portions extending downwardly along inner sides of the outer basket walls, means for connecting a source of current to the upper portions of the conductor strips, nuggets of metal packed in said baskets between the lower portions of said conductor strips and the front walls of the baskets, means for preventing build-up of metal through the perforations of the inner basket walls comprising a sheet of porous plastic material covering the concave sides of each of the inner basket walls and disposed between the inner basket walls and the cylinder, and supply means for plating solution including a manifold disposed along a lower portion of the inner wall of at least one of the baskets and having jet outlets for injecting plating solution between the porous plastic sheet and said cylinder.

* * * * *

UNITED STATES PATENT AND TRADEMARK OFFICE

CERTIFICATE OF CORRECTION

PATENT NO. : 4,352,727

DATED : October 5, 1982

INVENTOR(S) : Hubert Metzger

It is certified that error appears in the above-identified patent and that said Letters Patent is hereby corrected as shown below:

In the Notice, delete "Oct. 5, 1999", insert --May 25, 1999--.

In Column 2, line 33, after "walls", insert --15,--.

In Column 2, line 42, delete "34", insert --46--.

In Column 2, line 47, delete "basket" insert --cylinder--.

In Column 2, line 49 after "level 42", insert --at which is found outlet 44--.

In Column 2, line 51, delete "48".

In Column 3, line 2, delete "cylinder onto nuggets", insert --nuggets onto cylinder--.

In Column 3, line 7 after "walls", insert --15,--.

Signed and Sealed this

*Twenty-sixth* Day of *April 1983*

[SEAL]

*Attest:*

GERALD J. MOSSINGHOFF

*Attesting Officer*

*Commissioner of Patents and Trademarks*